US009429914B2

(12) United States Patent
Monferrer et al.

(10) Patent No.: US 9,429,914 B2
(45) Date of Patent: Aug. 30, 2016

(54) MECHANISM FOR DRIVING A JUMPING ELEMENT

(71) Applicant: Blancpain SA, Le Brassus (CH)

(72) Inventors: Bernat Monferrer, St-Prex (CH); Robin Rusterholz, Coppet (CH); Edmond Capt, Le Brassus (CH); Marco Rochat, Le Brassus (CH)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 14/958,162

(22) Filed: Dec. 3, 2015

(65) Prior Publication Data

US 2016/0170374 A1 Jun. 16, 2016

(30) Foreign Application Priority Data

Dec. 11, 2014 (EP) ..... 14197490
Mar. 16, 2015 (CH) ..... 356/15

(51) Int. Cl.
*G04B 15/08* (2006.01)
*G04B 15/14* (2006.01)
*G04B 13/00* (2006.01)

(52) U.S. Cl.
CPC ..... *G04B 15/14* (2013.01); *G04B 15/08* (2013.01); *G04B 13/00* (2013.01)

(58) Field of Classification Search
CPC ..... G04B 13/00; G04B 15/00; G04B 15/06; G04B 15/08; G04B 15/14
See application file for complete search history.

(56) References Cited

U.S. PATENT DOCUMENTS 2,921,476 A * 1/1960 Vogt ..... G04B 13/002 188/85
3,559,395 A 2/1971 Kikuchi
3,712,048 A * 1/1973 Bachmann ..... G04B 1/00 368/221
3,879,929 A 4/1975 Charbonney et al.
2004/0156273 A1 8/2004 Mojon et al.

(Continued)

FOREIGN PATENT DOCUMENTS

CH 511 471 A 4/1971
CH 707 743 A2 9/2014

(Continued)

OTHER PUBLICATIONS

European Search Report issued Aug. 24, 2015 in European Application 14197490, filed Dec. 11, 2014 (with English Translation).

*Primary Examiner* — Vit W Miska
(74) *Attorney, Agent, or Firm* — Oblon, McClelland, Maier & Neustadt, L.L.P.

(57) ABSTRACT

The invention relates to a mechanism for driving a jumping element comprising a drive wheel (1), an indicator of a unit of time, a jumping element (6) integral with said indicator and coaxial to said drive wheel (1) to which said jumping element (6) is coupled by a spring (8), a cam (12) arranged to rock a pallet-lever (20) in an oscillating motion so as to release the jumping element (6) once per unit of time. According to the invention, the cam (12) and the jumping element (6) have distinct pivot arbors, said drive mechanism, further comprising an intermediate train kinematically connecting the drive wheel (1) to the cam (12), and the pallet-lever (20) has four distinct arms (20*a*, 20*b*, 20*c*, 20*d*), two (20*a*, 20*b*) of the four arms forming feelers arranged to cooperate with the cam (12) and the other two arms (20*c*, 20*d*) forming escapement arms arranged to successively block and release the jumping element (6) once per unit of time, alternately.

15 Claims, 4 Drawing Sheets

(56) References Cited

U.S. PATENT DOCUMENTS

| | | | | |
|---|---|---|---|---|
| 2007/0127319 | A1* | 6/2007 | Goeller | G04B 1/225 368/124 |
| 2009/0067296 | A1* | 3/2009 | Schneider | G04B 15/10 368/140 |
| 2011/0235474 | A1 | 9/2011 | Wiederrecht | |
| 2013/0194900 | A1 | 8/2013 | Capt | |

FOREIGN PATENT DOCUMENTS

| | | | |
|---|---|---|---|
| EP | 1 772 783 | A1 | 4/2007 |
| EP | 2 068 210 | A2 | 6/2009 |
| EP | 2 166 419 | A1 | 3/2010 |
| EP | 2 397 920 | A1 | 12/2011 |
| FR | 2 257 935 | A1 | 8/1975 |
| WO | WO 2011/113757 | A1 | 9/2011 |

* cited by examiner

MECHANISM FOR DRIVING A JUMPING ELEMENT

This application claims priority from European Patent Application No. 14197490.7 filed on Dec. 11, 2014 and Swiss Patent Application No 00356/15 filed on Mar. 16, 2015; the entire disclosure of which are incorporated herein by reference.

FIELD OF THE INVENTION

The invention relates to the field of mechanical horology. It concerns, more specifically, a mechanism for driving a jumping element in a timepiece comprising a drive wheel arranged to rotate at constant speed, an indicator of a unit of time, a jumping element integral with said indicator and coaxial to said drive wheel to which said jumping element is coupled by a spring, a cam arranged to control a pallet-lever, said cam having a profile arranged to cause the pallet-lever to rock in an oscillating movement in order to release the jumping element once per unit of time. The present invention also concerns a timepiece comprising such a mechanism for driving a jumping element.

BACKGROUND OF THE INVENTION

When the drive wheel makes one revolution per minute, the unit of time may be the second. The drive mechanism can then form a deadbeat seconds mechanism, arranged to release the jumping element once per second. A deadbeat seconds mechanism comprises a deadbeat seconds indicator, generally a large hand at the centre of the dial, which "jumps" once per second. These mechanisms are extremely complicated to make. However they sometimes lack accuracy, as the "jumps" are made at ⅚ths of a second in some cases. They are also high energy consumers.

Some of these mechanisms are powered by a second energy source, specific to the deadbeat seconds mechanism, in addition to the main energy source required for the movement.

Other mechanisms are powered by the energy source of the movement, of the type described in the preamble. Such mechanisms are known to those skilled in the art and are described, for example, in CH Patent No 311865. In such mechanisms, the deadbeat seconds cam has a large number of teeth (30), involving small angular steps, which makes the jumps very sensitive to imperfections in the deadbeat seconds cam. Further, the same pallet-stone of the deadbeat seconds pallet-lever is used for cooperating both with the deadbeat seconds cam and the fourth wheel. The deadbeat seconds pallet-lever blocks the jumping element under the effect of force from the coupling spring and friction. This friction absorbs a relatively large amount of power, and therefore the energy consumed by the deadbeat seconds mechanism is high.

SUMMARY OF THE INVENTION

It is an object of the invention to overcome the various drawbacks of known mechanisms.

More specifically, it is an object of the invention to provide a mechanism for driving a jumping element, and in particular a deadbeat seconds mechanism, which is reliable, provides precise jumps at each unit of time, and notably at each second.

It is also an object of the invention to provide a mechanism for driving a jumping element, and particularly a deadbeat seconds mechanism that can provide regular steps throughout its life.

It is also an object of the invention to provide a mechanism for driving a jumping element, and particularly a deadbeat seconds mechanism, with reduced energy consumption, using the same energy source as that of the movement.

To this end, the present invention concerns a mechanism for driving a jumping element comprising a drive wheel arranged to rotate at constant speed, an indicator of a unit of time, a jumping element integral with said indicator and coaxial to said drive wheel, to which said jumping element is coupled by a spring, a cam arranged to control a pallet-lever, said cam having a profile arranged to rock the pallet-lever in an oscillating movement so as to release the jumping element once per unit of time.

According to the invention, the cam and the jumping element have separate pivot arbors, said drive mechanism also comprising an intermediate train kinematically connecting the drive wheel to the cam, and the pallet-lever has four separate arms, two of the four arms forming feelers arranged to cooperate with the cam and the other two arms forming escapement arms arranged to successively block and release the jumping element once per unit of time, alternately.

Advantageously, the intermediate train may comprise an intermediate wheel set formed of an intermediate pinion arranged to cooperate with the drive wheel and an intermediate wheel arranged to cooperate with a cam drive wheel integral with the cam.

Preferably, the intermediate train can be dimensioned so that the cam comprises less than thirty teeth, with each tooth having a front ramp, and makes more than one revolution per minute.

Advantageously, according to a variant embodiment, the unit of time is the second, the drive wheel being arranged to make one revolution in sixty seconds, and the indicator being a deadbeat seconds indicator, the cam may comprise ten teeth and be arranged to make three revolutions per minute, with each tooth having a front ramp divided into six steps.

Preferably, on the last three steps of the tooth, the front ramp of each tooth of the cam has a greater slope than the slope of the front ramp on the first three steps of the tooth.

Advantageously, the four arms of the pallet-lever may be arranged substantially to form an X-shape, the feeler arm positioned to cooperate with the cam being arranged oppositely, relative to the pivot point of the pallet-lever, to the escape arm positioned to release the jumping element.

Advantageously, said drive mechanism also comprises a mechanism for securing the relative position of the drive wheel and the jumping element.

Preferably, the mechanism for securing the relative position of the drive wheel and the jumping element may comprise first abutment means provided on the drive wheel and a first stop member provided on the jumping element, said first abutment means being arranged to abut on the first stop member and limit the travel of the jumping element, when the drive wheel and the jumping element rotate in opposite directions.

Preferably, the mechanism securing the relative position of the drive wheel and the jumping element may comprise second abutment means arranged on the drive wheel and a second stop member provided on the jumping element, said second abutment means being arranged to abut on the second stop member and limits the travel of the drive wheel when the jumping element is stopped.

Advantageously, said first and second abutment means may comprise a pin. In another variant, the first and second abutment means may comprise an eccentric.

Advantageously, the jumping element maybe a wheel having at least two recessed areas separated by at least one arm, and the first and second abutment means are disposed on either side of the arm, said arm forming at least one of the first and second stop members on which the first and second abutment means are respectively capable of abutting.

The mechanism for driving a jumping element according to the invention makes it possible to obtain precise jumps at each unit of time while allowing for reduced energy consumption. Further, the jumps will be regular, throughout the entire life of the mechanism.

The present invention also concerns a timepiece comprising a timepiece movement provided with a going train powered by an energy source, and a jumping element drive mechanism as defined above.

Advantageously, the drive wheel of the deadbeat seconds mechanism may be powered by the energy source of the movement.

Preferably, the drive wheel may be the fourth wheel of the going train.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF A PREFERRED EMBODIMENT

The following description concerns one embodiment of the invention in which the unit of time is the second. The drive mechanism thus constitutes "a deadbeat seconds mechanism", and will be designated as such hereinafter.

Figure 1:
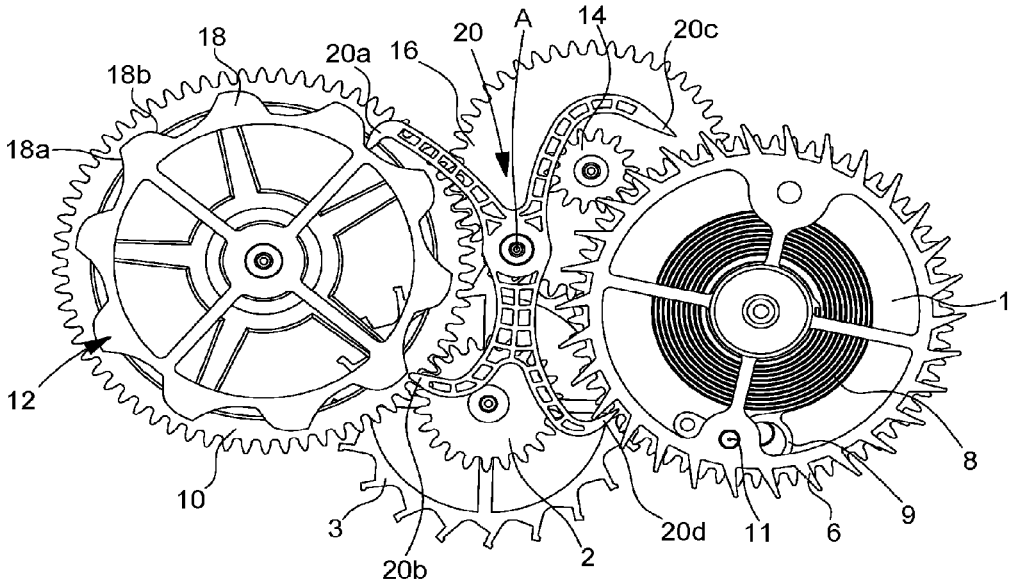
FIGS. 1 to 4 show a top view of a deadbeat seconds mechanism according to the invention, the deadbeat seconds pallet-lever occupying different positions as a function of the steps of a tooth of the deadbeat seconds cam.

Referring to FIG. 1, the deadbeat seconds mechanism according to the invention is incorporated in a mechanical timepiece, comprising a timepiece movement provided with a going train powered by an energy source, such as a barrel. The going train conventionally comprises a fourth wheel 1, comprising 60 teeth and arranged to make one revolution in 60 seconds. The movement also comprises, in a conventional manner, and escape pinion 2 and an escape wheel 3 in addition to an escapement pallet-lever and a balance. These elements are known to those skilled in the art and do not require detailed description. It will be noted, however, that the frequency of the balance is advantageously selected to be 3 Hz, as will be understood below.

The deadbeat seconds mechanism comprises a drive wheel formed more specifically here by the fourth wheel 1 of the going train.

Figure 7:
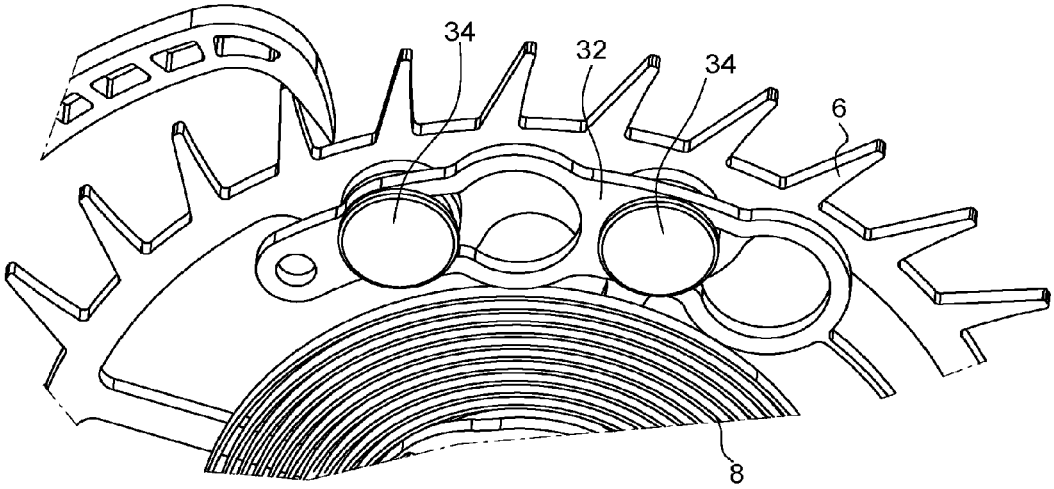
FIG. 7 is a perspective view of the attachment of the balance spring to the jumping element.

The deadbeat seconds mechanism also comprises a jumping element 6, such as a wheel, integral with a deadbeat seconds indicator, such as a hand (not shown). Jumping element 6 is mounted for free rotation on the arbor of fourth wheel 1, so that jumping element 6 is coaxial to fourth wheel 1 and not integral therewith. Jumping element 6 is elastically connected to fourth wheel 1 by means of a spiral spring 8, which is pressed onto fourth wheel 1 on the one hand, and fixed to jumping element 6 on the other hand. According to a first variant, spiral spring 8 comprises at the end thereof intended to be fixed to jumping element 6, a securing slot 9 in which a holding stud 11 is inserted, provided on the jumping element. According to a second variant shown in FIG. 7, spiral spring 8 comprises at the end thereof intended to be fixed to jumping element 6, a double securing slot 32 having two housings or slots. Jumping element 6 is provided with two holding studs 34, each holding stud 34 being intended to be inserted in one of the housings of the double securing slot 32. Holding studs 34 are arranged to limit axial play. More specifically, each holding stud 34 comprises a groove around which each slot is positioned. Thus, the double securing slot makes it possible to ensure that spiral spring 8 remains flat during the operation of the mechanism. Jumping element 6 is a wheel comprising 30 teeth and making one revolution in 60 seconds.

The deadbeat seconds mechanism also comprises a deadbeat seconds cam wheel set formed of a cam drive wheel 10 and a deadbeat seconds cam 12, integral with said cam drive wheel 10. Cam drive wheel 10 is arranged to cooperate with escape pinion 2. More specifically, cam drive wheel 10 meshes directly with escape pinion 2

According to the invention, fourth wheel 1 and cam drive wheel 10 are mounted to pivot on the frame of the movement so as to have separate pivot arbors, such that deadbeat seconds cam 12 and jumping element 6 (or fourth wheel 1) are not coaxial.

Further, fourth wheel 1 and cam drive wheel 10 are kinematically connected by an intermediate train, and more specifically an intermediate wheel set comprising an intermediate pinion 14 meshing with fourth wheel 1 and an intermediate wheel 16, integral with said intermediate pinion 14, and meshing with cam drive wheel 10. Thus, the main kinematic chain of the movement goes from fourth wheel 1 to escape pinion 2 passing in succession through the intermediate train and cam drive wheel 10, with no direct meshing between the drive pinion and the fourth wheel. According to a preferred embodiment, the dimensions and number of teeth of the intermediate wheel set are arranged such that cam drive wheel 10 and deadbeat seconds cam 12 make one revolution per twenty seconds, namely three revolutions per minute, with cam drive wheel 10 comprising sixty-six teeth and deadbeat seconds cam 12 comprising ten teeth 18. It is clear that the speed of the cam drive wheel and of the deadbeat seconds cam, and the number of teeth, may be modified without departing from the scope of the present invention. It is possible, for example, to choose a period of sixteen seconds, with a deadbeat seconds cam comprising eight teeth.

The deadbeat seconds mechanism also comprises a deadbeat seconds pallet-lever 20 mounted to pivot at a pivot point A on the frame of the movement, and controlled by deadbeat seconds cam 12 to release and make jumping element 6 jump once per second. Jumping element 6 thus forms a deadbeat second escape wheel.

According to the invention, the deadbeat seconds pallet-lever 20 comprises four distinct arms 20*a*, 20*b*, 20*c* and 20*d*. The end of each of the arms acts as a pallet-stone. In the following description, the term "pallet-stone" is used to designate the end of an arm 20*a*, 20*b*, 20*c* and 20*d*, the pallet-stone thus forming one-piece with the corresponding arm. Advantageously, the deadbeat seconds pallet-lever 20 is made in one-piece by a LIGA method. Upper arm 20*a* and lower arm 20*b* form upper and lower feelers arranged to cooperate with deadbeat seconds cam 12. Upper arm 20*c* and lower arm 20*d* form upper and lower escape arms arranged to successively block and release jumping element 6 once per second, alternately. The 4 arms 20*a*, 20*b*, 20*c* and 20*d* are positioned with respect to pivot point A to substantially form an X-shape, the end of each arm being bent to be capable of cooperating either with deadbeat seconds cam 12 or with jumping element 6. Arms 20*a*, 20*b*, 20*c* and 20*d* work in opposition with respect to pivot point A. For example, as shown in FIG. 1, upper feeler arm 20*a* is positioned to be controlled by the profile of tooth 18 of deadbeat seconds cam 12, whereas the opposite escape arm with respect to pivot point A, namely lower escape arm 20*d*, is positioned to release jumping element 6.

Each tooth 18 of deadbeat seconds cam 12 has a profile defined by a front ramp 18*a*, which is a functional part of the tooth on which the end or the pallet-stone of feeler arms 20*a*, 20*b* rubs, and a back side 18*b*. Advantageously, the frequency of the balance is selected to be 3 Hz (namely six vibrations per second) so that each front ramp 18*a* can be divided into six steps, each step corresponding to an angle of rotation of 3° of the deadbeat seconds cam. It is clear that another frequency could be chosen. A movement along the front ramp 18*a* of a tooth 18 thus corresponds to an angle of rotation of 18° of the deadbeat seconds cam. In order to obtain a precise jump, the front ramp 18*a* of each tooth 18 has a slope which is greater on the last three steps corresponding to an angle of rotation of the deadbeat seconds cam comprised between 9° and 18°, namely at the moment close to the jump, than on the first three steps corresponding to an angle of rotation of the deadbeat seconds cam comprised between 0° and 9°. As shown more precisely in FIG. 5, assuming that at the start of the tooth, at an angle of 0°, the height is equal to 0, and that the total tooth height h corresponds to an angle of rotation of 18° of the deadbeat seconds cam, the height a of the tooth corresponding to the third step, namely an angle of rotation of 9° of the deadbeat seconds cam, is comprised between 10% and 15% of height h, and the height b of the tooth corresponding to the fifth step, namely an angle of rotation of 15° of the deadbeat seconds cam, is comprised between 55% and 60% of height h.

The profile of back side 18*b* prevents a premature jump of the deadbeat seconds pallet-lever. This profile is the resultant of the profile of front ramp 18*a*, such that, when the pallet-stone of one of the feeler arms is in contact with the front ramp 18*a* of a tooth 18 of deadbeat seconds cam 12, constant play is maintained between deadbeat seconds cam 12 and the 'passive' pallet-stone of the other feeler arm (that is to say, the pallet-stone of the feeler arm which is not in contact with the front ramp of a tooth).

Figure 4:
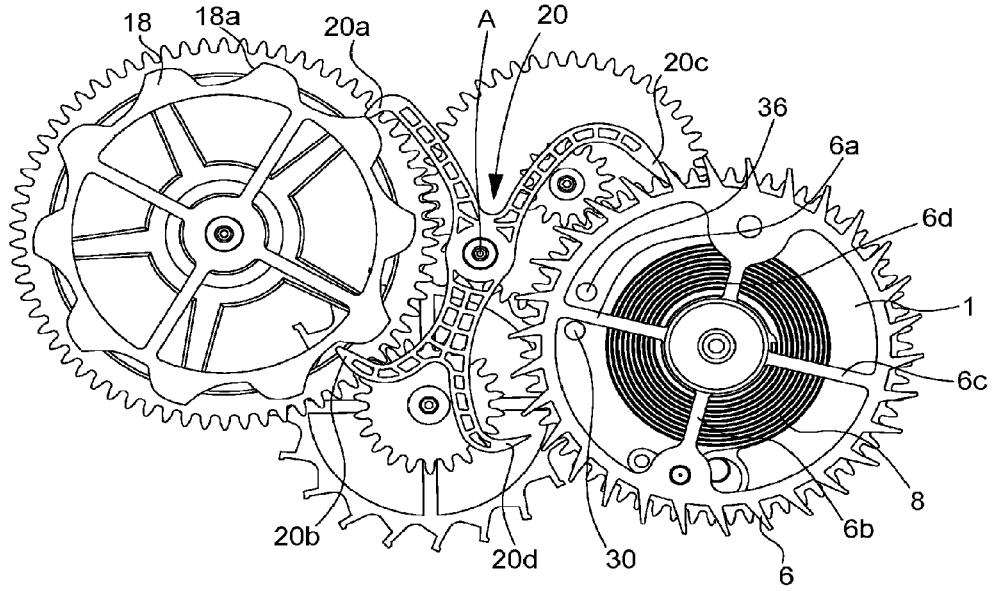

Further, there is provided a mechanism for securing the relative position of fourth wheel 1 and jumping element 6 in order to ensure permanent indexing of fourth wheel 1 and jumping element 6, including when the jumping element drive mechanism has stopped once the movement has stopped. Referring to FIG. 4, said mechanism for securing the relative position of fourth wheel 1 and jumping element 6 comprises a first pin 30 and a second pin 36 pressed onto fourth wheel 1. Said pins 30 and 36 are shown only in FIG. 4 in order to simplify the drawings. Further, jumping element 6 is a toothed wheel having four recessed areas whose edges form four separating arms 6*a*, 6*b*, 6*c*, 6*d*. Pins 30 and 36 are positioned on fourth wheel 1 on either side of one of separating arms 6*a*. More specifically, first pin 30 is positioned to be at the front of separating arm 6*a* of jumping element 6 when fourth wheel 1 and jumping element 6 rotate in the same direction, notably during normal operation of the mechanism. When fourth wheel 1 rotates in an opposite direction to that of jumping element 6, notably when the time of the movement is set, first pin 30, integral with fourth wheel 1, abuts on separating arm 6*a* of jumping element 6, and separating arm 6*a* thus forms a stop member for first pin 30. First pin 30, continuing its motion with fourth wheel 1, drives separating arm 6*a* and thus jumping element 6 therewith, such that fourth wheel 1 and jumping element 6 move backwards together and remain indexed, notably during time-setting.

Second pin 36 is positioned to be at the back of separating arm 6*a* of jumping element 6 when fourth wheel 1 and jumping element 6 rotate in the same direction, notably during normal operation of the mechanism. A distance of at least one step, and preferably equal to one step, is provided. When jumping element 6 is stopped, for example when the hands are fitted, second pin 36, which is integral with fourth wheel 1, will abut on separating arm 6*a* of jumping element 6 as it moves in the normal direction, and separating arm 6*a* thus forms a stop member for second pin 36. Second pin 36 abuts against the stopped jumping element 6, such that fourth wheel 1 is stopped and consequently the rest of the mechanism. Thus, fourth wheel 1 and jumping element 6 are both stopped and remain indexed, particularly when the hands are fitted.

Thus, the relative position of fourth wheel 1 and jumping element 6 is secured, so that there is no loss of tension on spiral spring 8.

Figure 6:
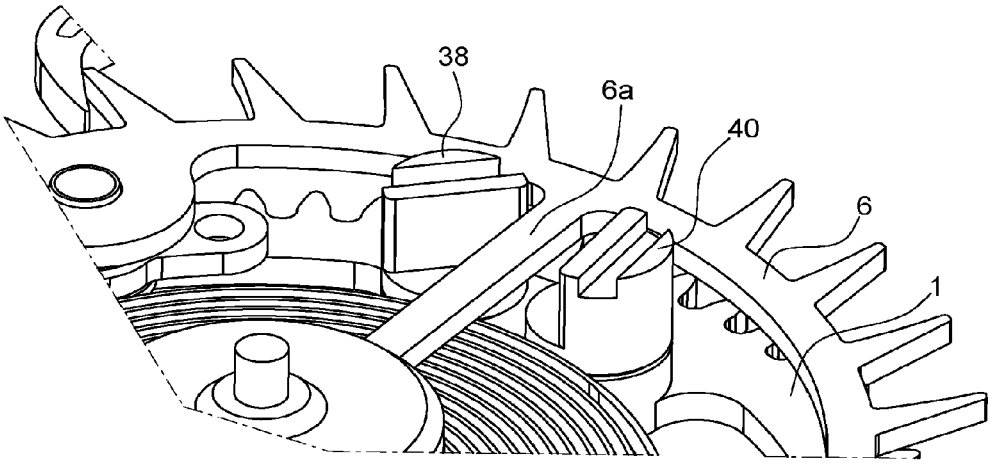
FIG. 6 is a perspective view of a variant embodiment of the mechanism for securing the relative position of the drive wheel and the jumping element

Referring to FIG. 6, another variant of the securing mechanism is shown. According to this variant, the first and second abutment means comprise an eccentric element 38, 40 instead of first pin 30 and second pin 36 respectively, having the same function. The advantage of eccentric elements 38 and 40 compared to pins 30, 36 is that they can be moved and positioned by the watchmaker to adjust the play between the two eccentric elements 38, 40 and separating arm 6*a* of jumping element 6. This means less reliance on manufacturing tolerances.

According to another variant embodiment which is not shown, the first abutment means are positioned to be at the front of one of the separating arms of jumping element 6 when fourth wheel 1 and jumping element 6 rotate in the same direction, and the second abutment means are positioned to be at the back of another separating arm of jumping element 6 when fourth wheel 1 and jumping element 6 rotate in the same direction. Thus, one of the separating arms of jumping element 6 forms the first stop member on which the first abutment means are capable of abutting and the other separating arm of jumping element 6 forms the second stop member on which the second abutment means are capable of abutting.

In another variant embodiment that is not shown, the first and second stop members are not formed by the separating arms of the jumping element but are parts pressed onto jumping element 6 and arranged to be capable of entering into contact with their respective abutment means, notably pins or eccentric elements, provided on the drive wheel.

The operation of the deadbeat seconds mechanism is as follows: referring to FIGS. 1 to 5, fourth wheel 1 drives intermediate pinion 14 and thus intermediate wheel 16, which in turn drives cam drive wheel 10 and thus deadbeat seconds cam 12. As it rotates, said deadbeat seconds cam 12 allows the front ramp 18*a* of a tooth 18 to act on the pallet-stone of upper feeler arm 20*a* of deadbeat seconds pallet-lever 20, so that said pallet-lever rocks about its pivot point A and, on the opposite side, releases the pallet-stone of lower escape arm 20*d* of deadbeat seconds pallet-lever 20 from the toothing of jumping element 6 opposite.

Figure 5:
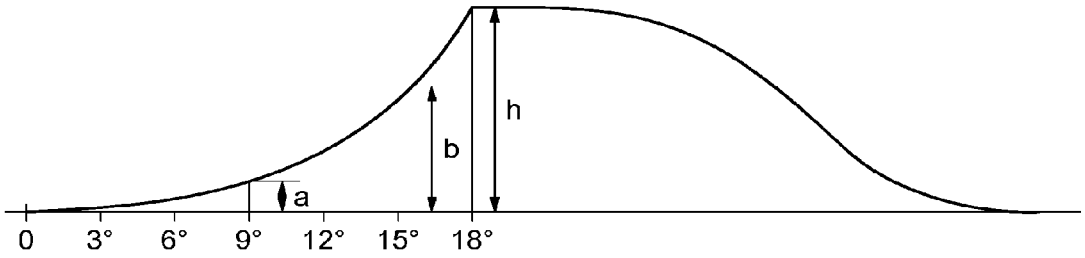
FIG. 5 shows a profile view of a tooth of the deadbeat seconds cam.

More specifically, between step 0, shown in FIG. 1, and the fifth step of the front ramp 18*a* of the tooth concerned (namely at a 15° angle of rotation of deadbeat seconds cam 12, cf. FIG. 5), the pallet-stone of lower escape arm 20*d* does not leave the toothing of jumping element 6, regardless of any correction of play. The asymmetrical profile of each tooth 18 of deadbeat seconds cam 12 is such that the lift of the pallet-lever occurs gradually with the pallet-stone of upper feeler arm 20*a* while the pallet-stone of lower feeler arm 20*b* descends without touching deadbeat seconds cam 12.

Figure 2:
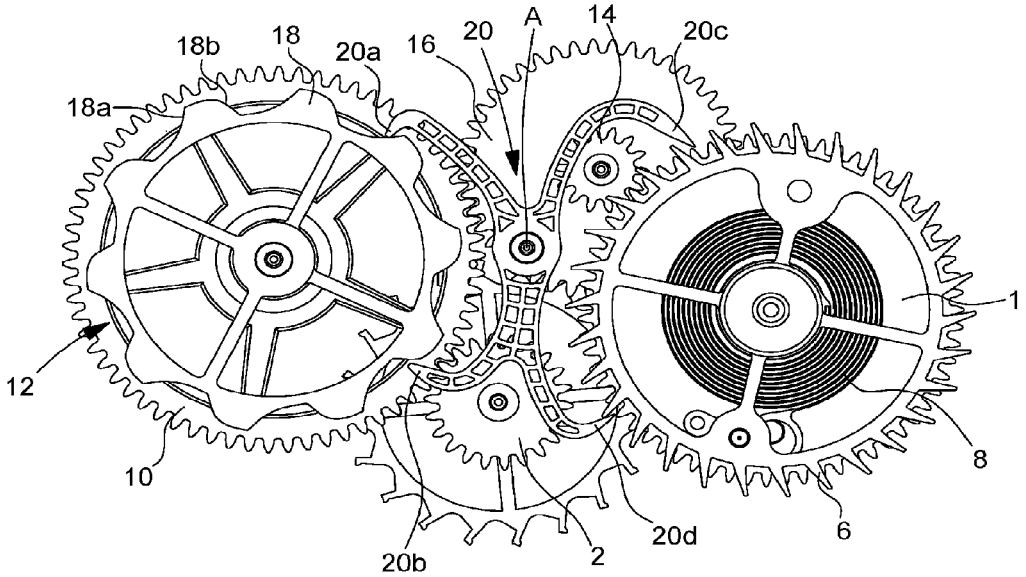
Figure 3:
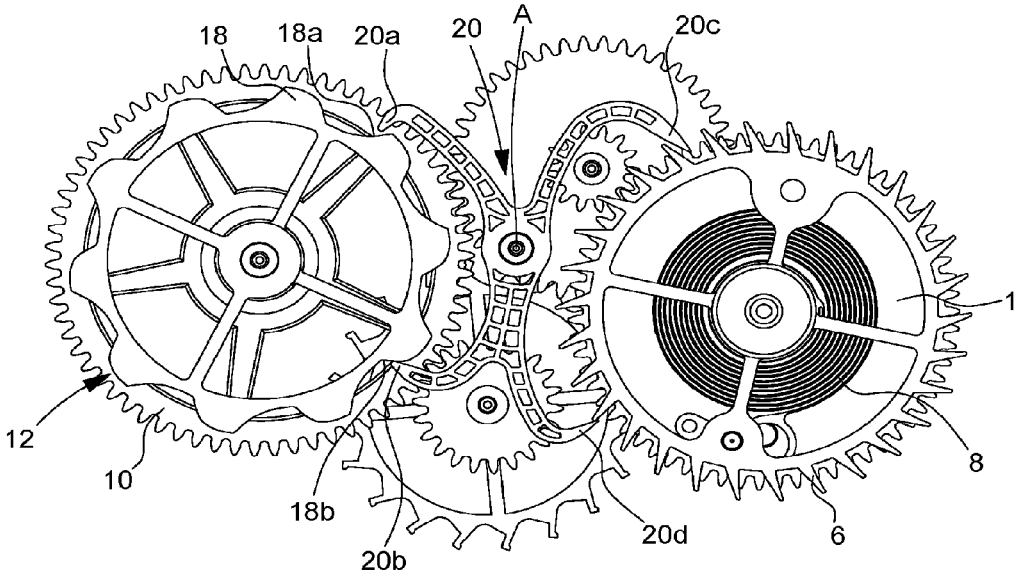

When the pallet-stone of upper feeler arm 20*a* reaches the fifth step of front ramp 18*a*, as shown in FIG. 2, jumping element 6 has not yet jumped, and is blocked by the pallet-stone of lower escape arm 20*d*. Once the pallet-stone of upper feeler arm 20*a* reaches the fifth step of front ramp 18*a*, if the play of deadbeat seconds pallet-lever 20 is corrected, after a shock for example, the pallet-stone of lower feeler arm 20*b* is placed in contact with the back side 18*b* of the tooth 18 concerned of deadbeat seconds cam 12, as shown in FIG. 3. Even in this configuration, jumping element 6 has not jumped, but remains about to jump. Jumping element 6 jumps when the pallet-stone of upper feeler arm 20*a* moves between the fifth and sixth step. When the pallet-stone of upper feeler arm 20*a* reaches the sixth step of front ramp 18*a*, as shown in FIG. 4, jumping element 6 has jumped. The deadbeat seconds pallet-lever has rocked, therefore the pallet-stone of lower escape arm 20*d* has come out of jumping element 6 and released it. Jumping element 6, returned by spiral spring 8 fixed on fourth wheel 1, turns through 6°, namely an advance or a jump of one second of the deadbeat seconds indicator. The jumping element is then blocked again, this time by the pallet-stone of upper escape arm 20*c*, on which it is held pressed by means of spiral spring 8, as shown in FIG. 4. It is the pallet-stone of lower feeler arm 20*b*, in opposition with respect to pivot point A, which will enter into contact with the front ramp 18*a* of a tooth of deadbeat seconds cam 12, to rock the deadbeat seconds pallet-lever 20 in the other direction and release the jumping element again. Thus, the movement of the deadbeat seconds pallet-lever is an alternating movement which can release jumping element 6, tooth after tooth, once with the pallet-stone of upper escape arm 20*c*, and then with the pallet-stone of lower escape arm 20*d*, in a successive and alternate manner. Consequently, the deadbeat seconds indicator advances in one-second increments.

The deadbeat seconds mechanism of the invention makes it possible to obtain accurate jumps every second with lower energy consumption. Indeed, the mechanism of the invention is powered by the same energy source as the going train. A second energy source is unnecessary. Further, the arrangement of the jumping element and deadbeat seconds cam on separate arbors makes it possible to provide optimised shapes for the pallet-stones of the escape arms on the one hand and for the pallet-stones of the feeler arms on the other hand, combined with optimised shapes of the teeth of the deadbeat seconds cam. The energy consumed by the spiral spring between the fourth wheel and the jumping element is virtually zero. In particular, the greater the slope of the front ramp of the deadbeat seconds cam teeth, on the last three steps of the tooth, the more marked and therefore more precise the jump will be. A smaller slope on the last three steps of the tooth means that the angular pitch of the deadbeat seconds pallet-lever is relatively low over this period. Torque consumption is thus low. The slope on the last three steps is greater, but must still remain measured in order to avoid excessive torque consumption on the deadbeat seconds cam wheel set. Consequently, the angular pitch of the deadbeat seconds pallet-lever is higher on the last three steps, which makes it possible for the jump to be performed over a larger range of measurement, and the accuracy of the jump to be increased accordingly. Further, the use of a deadbeat seconds cam having only ten teeth can provide a greater angular pitch, and thus jumps that are less sensitive to imperfections in the deadbeat seconds cam.

All the parts of the deadbeat seconds mechanism directly connected to the deadbeat seconds indicator are recessed to make them as light as possible and thereby reduce inertia and torque consumption. Further, these recesses allow the parts to be balanced, in order to obtain an unbalance close to zero.

Further, the radius forming the side of the toothing of the jumping element is selected to be concentric and equal to that of the deadbeat seconds pallet-lever with which it is in contact. Consequently, when the deadbeat seconds pallet-lever rocks, the jumping element does not move, which ensures the stability of the deadbeat seconds indicator.

Finally, the arrangement of the jumping element and the deadbeat seconds cam on separate arbors avoids adding a large number of parts to the same arbor and thus limits the accumulation of tolerances and misalignment of wheel sets, unlike the coaxial mechanisms of the prior art. Precision on the arbor of the jumping element is thus greater while simplifying the assembly of the parts.

It is clear that the deadbeat seconds mechanism described above can be adapted to a unit of time other than the second. Thus, the mechanism for driving a jumping element according to the invention can be adapted to the display of any unit of time: seconds, minutes, tens of seconds, tens of minutes, etc. To achieve this, those skilled in the art know how to suitably adapt the number of teeth on the cam and on the jumping element, and the gear ratios in the going train.

What is claimed is:

1. A drive mechanism for driving a jumping element in a timepiece comprising a drive wheel, an indicator of a unit of time, a jumping element integral with said indicator and coaxial to said drive wheel to which said jumping element is coupled by a spring, a cam arranged to control a pallet-lever, said cam having a profile arranged to cause the pallet-lever to rock in an oscillating motion so as to release the jumping element once per unit of time, wherein the cam and the jumping element have distinct pivot arbors, said drive mechanism, further comprising an intermediate train kinematically connecting the drive wheel to the cam, and wherein the pallet-lever has four distinct arms, two of the four arms forming feelers arranged to cooperate with the cam and the other two arms forming escapement arms arranged to successively block and release the jumping element once per unit of time, alternately.

2. The drive mechanism according to claim 1, wherein the intermediate train comprises an intermediate wheel set formed of an intermediate pinion arranged to cooperate with the drive wheel and an intermediate wheel arranged to cooperate with a cam drive wheel integral with the cam.

3. The drive mechanism according to claim 1, wherein the intermediate train is dimensioned such that the cam comprises less than thirty teeth, with each tooth having a front ramp, and makes more than one revolution per minute.

4. The drive mechanism according to claim 1, wherein the unit of time is the second, the drive wheel being arranged to make one revolution in 60 seconds, and the indicator being a deadbeat seconds indicator, and wherein the cam comprises ten teeth and is arranged to make three revolutions per minute, each tooth having a front ramp divided into six steps.

5. The drive mechanism according to claim 3, wherein the front ramp of each tooth of the cam has, on the last three steps of the tooth, a greater slope than the slope of the front ramp on the first three steps of the tooth.

6. The drive mechanism according to claim 1, wherein the four arms of the pallet-lever are arranged substantially to form an X-shape, the feeler arm positioned to cooperate with the cam being arranged oppositely, relative to the pivot point of the pallet-lever, to the escapement arm positioned to release the jumping element.

7. The drive mechanism according to claim 1, wherein the drive mechanism comprises a mechanism for securing the relative position of the drive wheel and the jumping element.

8. The drive mechanism according to claim 7, wherein the mechanism for securing the relative position of the drive wheel and the jumping element comprises first means of abutment provided on the drive wheel and a first stop member provided on the jumping element, said first means of abutment being arranged to abut on the first stop member when the drive wheel and the jumping element rotate in opposite directions.

9. The drive mechanism according to claim 7, wherein the mechanism for securing the relative position of the drive wheel and the jumping element comprises second means of abutment provided on the drive wheel and a second stop member provided on the jumping element, said second means of abutment being arranged to abut on the second stop member when the jumping element is stopped.

10. The drive mechanism according to claim 9, wherein the first and second means of abutment comprise a pin.

11. The drive mechanism according to claim 9, wherein the first and second means of abutment comprise an eccentric.

12. The drive mechanism according to claim 9, wherein the jumping element is a wheel having at least two recessed areas separated by at least one separating arm, and wherein the first and second means of abutment are disposed on either side of said at least one separating arm, said separating arm forming at least one of the first and second stop members on which the first and second means of abutment are respectively capable of abutting.

13. A timepiece comprising a timepiece movement provided with a going train powered by an energy source, wherein the timepiece comprises a drive mechanism for driving a jumping element according to claim 1.

14. The timepiece according to claim 13, wherein the drive wheel is powered by the energy source of the movement.

15. The timepiece according to claim 13, wherein the drive wheel is the fourth wheel of the going train.

* * * * *